US011430582B2

(12) United States Patent
Ito et al.

(10) Patent No.: US 11,430,582 B2
(45) Date of Patent: Aug. 30, 2022

(54) ROUTING MATERIAL AND MANUFACTURING METHOD THEREOF

(71) Applicant: TOYOTA JIDOSHA KABUSHIKI KAISHA, Toyota (JP)

(72) Inventors: Jiro Ito, Toyota (JP); Taku Furuta, Makinohara (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/101,027

(22) Filed: Nov. 23, 2020

(65) Prior Publication Data

US 2021/0241937 A1 Aug. 5, 2021

(30) Foreign Application Priority Data

Feb. 3, 2020 (JP) ..... JP2020-016512

(51) Int. Cl.

| | |
|---|---|
| ***H01B 7/08*** | (2006.01) |
| ***H01B 7/00*** | (2006.01) |
| ***B21D 5/02*** | (2006.01) |
| ***H01B 1/02*** | (2006.01) |

(52) U.S. Cl.

CPC ..... *H01B 7/0081* (2013.01); *B21D 5/02* (2013.01); *H01B 1/023* (2013.01); *H01B 7/08* (2013.01)

(58) Field of Classification Search

CPC ..... H01B 1/023; H01B 7/0081; H01B 7/08; H01R 4/22; H01R 4/2425; H01R 11/11; H01R 12/70; H01R 13/46; H01R 13/50; H01R 13/52; H01R 13/504; H01R 13/516; H01R 13/5202; H01R 13/5213; H01R 13/56; H01R 13/562; H01R 12/58

USPC ..... 174/74 R, 77 R, 80, 84 R, 89, 92, 94 R, 174/95, 96, 97, 98, 99 R

See application file for complete search history.

(56) References Cited

U.S. PATENT DOCUMENTS

| | | | | |
|---|---|---|---|---|
| 1,668,953 | A * | 5/1928 | Erickson | H02G 3/0487 174/101 |
| 4,801,764 | A * | 1/1989 | Ohlhaber | H01B 7/08 174/117 F |
| 5,823,817 | A * | 10/1998 | Pyle | H01R 13/562 439/447 |
| 6,872,888 | B2 * | 3/2005 | Santelli, Jr. | H02G 3/0468 138/118 |
| 7,504,579 | B2 * | 3/2009 | Frank | H02G 3/0468 174/36 |
| 10,431,351 | B2 * | 10/2019 | Mizuno | H01B 7/24 |
| 2010/0263926 | A1 * | 10/2010 | Murayama | B60R 16/0207 174/71 R |
| 2014/0174784 | A1 * | 6/2014 | Ichikawa | H02G 3/0468 174/68.3 |

(Continued)

FOREIGN PATENT DOCUMENTS

JP 2018-206663 A 12/2018

*Primary Examiner* — William H. Mayo, III

(74) *Attorney, Agent, or Firm* — Oblon, McClelland, Maier & Neustadt, L.L.P.

(57) ABSTRACT

A flat routing material includes a flat conductive material and an insulating coating covering the conductive material. The routing material includes a bent portion as a part bending in an edgewise direction at a predetermined angle or more, and one or more folds extending toward the outer peripheral side of the bent portion are provided on at least the inner peripheral side of the bent portion. The folds are manufactured by press working.

6 Claims, 4 Drawing Sheets

(56) References Cited

U.S. PATENT DOCUMENTS

| | | | | |
|---|---|---|---|---|
| 2015/0041210 | A1* | 2/2015 | Inao | B60R 16/0215 174/72 A |
| 2016/0009234 | A1* | 1/2016 | Adachi | H02G 3/0468 174/72 A |
| 2016/0064906 | A1* | 3/2016 | Wakabayashi | H02G 3/0481 174/68.3 |
| 2016/0101747 | A1* | 4/2016 | Inao | H02G 3/0487 174/72 A |
| 2016/0164269 | A1* | 6/2016 | Inao | H02G 3/0468 174/68.3 |
| 2016/0276063 | A1* | 9/2016 | Mizuno | H01B 7/0823 |
| 2018/0315517 | A1 | 11/2018 | Fukawa et al. | |

* cited by examiner

ROUTING MATERIAL AND MANUFACTURING METHOD THEREOF

CROSS-REFERENCE TO RELATED APPLICATION

This application claims priority to Japanese Patent Application No. 2020-016512 filed on Feb. 3, 2020, incorporated herein by reference in its entirety.

BACKGROUND

1. Technical Field

This disclosure relates to a routing material and a manufacturing method thereof.

2. Description of Related Art

A flat conductive material called a bus bar and having a generally rectangular section is used in vehicles and the like. When the extending direction of the bus bar is to be bent in a desired shape for wiring, bending to an edgewise direction where machining is difficult might be requested.

Japanese Unexamined Patent Application Publication No. 2018-206663 (JP 2018-206663 A) describes the following technique. That is, bending to an edgewise direction is performed on a flat conductive material made of aluminum alloy by heating a machining portion to not less than 100° C. but not more than 250° C. Hereby, workability is improved, and cracks in a bending outer peripheral portion are restrained.

SUMMARY

In a case where a routing material formed by integrally molding, by extrusion, a flat conductive material and an insulating coating made of resin or the like is subjected to bending into an edgewise direction, when the method described in JP 2018-206663 A is employed, the insulating coating might deteriorate or tear by heat.

Further, when such bending is performed, the outer peripheral side of the conductive material is stretched out as compared to the inner peripheral side of the conductive material, so that the thickness of the conductive material becomes uneven such that the thickness on the outer peripheral side becomes smaller than the thickness on the inner peripheral side. This increases resistance on the outer peripheral side the thickness of which is thinned, so that a decrease in current, heat generation, or the like occur. This might cause a decrease in current application performance of the conductive material.

This disclosure is accomplished in view of the above problems, and an object of the disclosure is to provide a routing material including a flat conductive material and an insulating coating and configured such that a bent portion bent to an edgewise direction is formed appropriately.

In order to achieve the above object, one aspect of this disclosure relates to a flat routing material including a flat conductive material and an insulating coating covering the conductive material. The routing material includes a bent portion as a part bending to an edgewise direction at a predetermined angle or more. One or more folds extending toward the outer peripheral side of the bent portion are provided on at least the inner peripheral side of the bent portion.

Further, another aspect of this disclosure relates to a manufacturing method of a routing material, and the manufacturing method includes a step of bending, to an edgewise direction, a flat routing material including a flat conductive material and an insulating coating covering the conductive material, by pressing the routing material by a mold so as to form one or more folds on at least a first edge side of the routing material such that the one or more folds extend toward a second edge side of the routing material. The routing material is bent such that the first edge side becomes the inner peripheral side of the routing material.

This disclosure can provide a routing material including a flat conductive material and an insulating coating and configured such that a bent portion bending to an edgewise direction is formed appropriately by forming folds on the inner peripheral side of the conductive material and gathering the inner peripheral side of the conductive material in a folded manner.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Embodiment

The following describes a routing material according to one embodiment in the technology of this disclosure in detail with reference to the drawings.

Configuration

Figure 1:
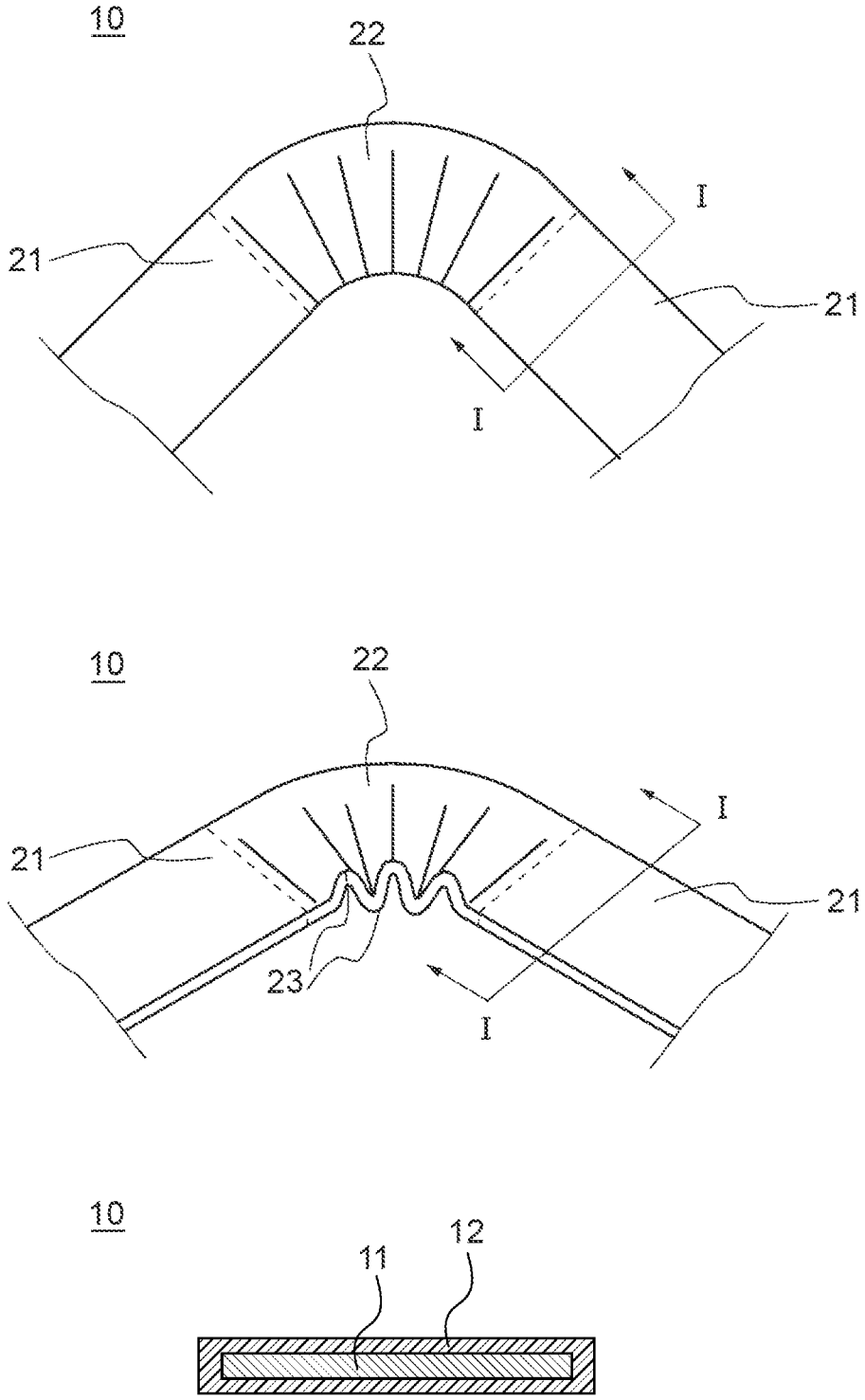
FIG. 1 illustrates a plan view, a perspective view, and a sectional view of an essential part of a routing material according to one embodiment.

FIG. 1 illustrates a plan view and a perspective view of an essential part of a routing material 10 according to the present embodiment and a sectional view taken along a line I-I in those views. The routing material 10 is a flat routing material including a flat conductive material 11 and an insulating coating 12 covering the conductive material 11. The conductive material 11 has a generally rectangular shape on a section perpendicular to the extending direction of the routing material 10 and has a generally uniform thickness.

The routing material 10 includes a linear portion 21 uniform in the extending direction and a bent portion 22 that bends to an edgewise direction at a predetermined angle or more. Here, to bend in the edgewise direction indicates that the routing material 10 bends such that a first side edge out of side edges becomes the inner peripheral side, and a second side edge out of the side edges becomes the outer peripheral side. The side edges correspond to short sides of a generally rectangular sectional shape of the section perpendicular to the extending direction of the routing material 10.

In the bent portion 22, one or more folds 23 are formed from the side edge on the inner peripheral side toward the outer peripheral side. The folds 23 are formed, for example, such that the height of the folds 23 decreases from the inner peripheral side to the outer peripheral side, and respective edge lines of the folds 23 extend generally in the curvature radius direction of the routing material 10. As illustrated herein, the folds 23 may not reach the side edge on the outer peripheral side, or the folds 23 may reach the side edge on the outer peripheral side.

The routing material 10 may include a plurality of bent portions 22. Further, the bending angle of each bent portion 22 is not limited. Note that the routing material 10 may include a part the bending angle of which is less than the predetermined angle, the part being not provided with folds. Further, the routing material 10 may include a part bent by flat wise bending or the like other than edgewise bending.

Manufacturing Method

Figure 2:
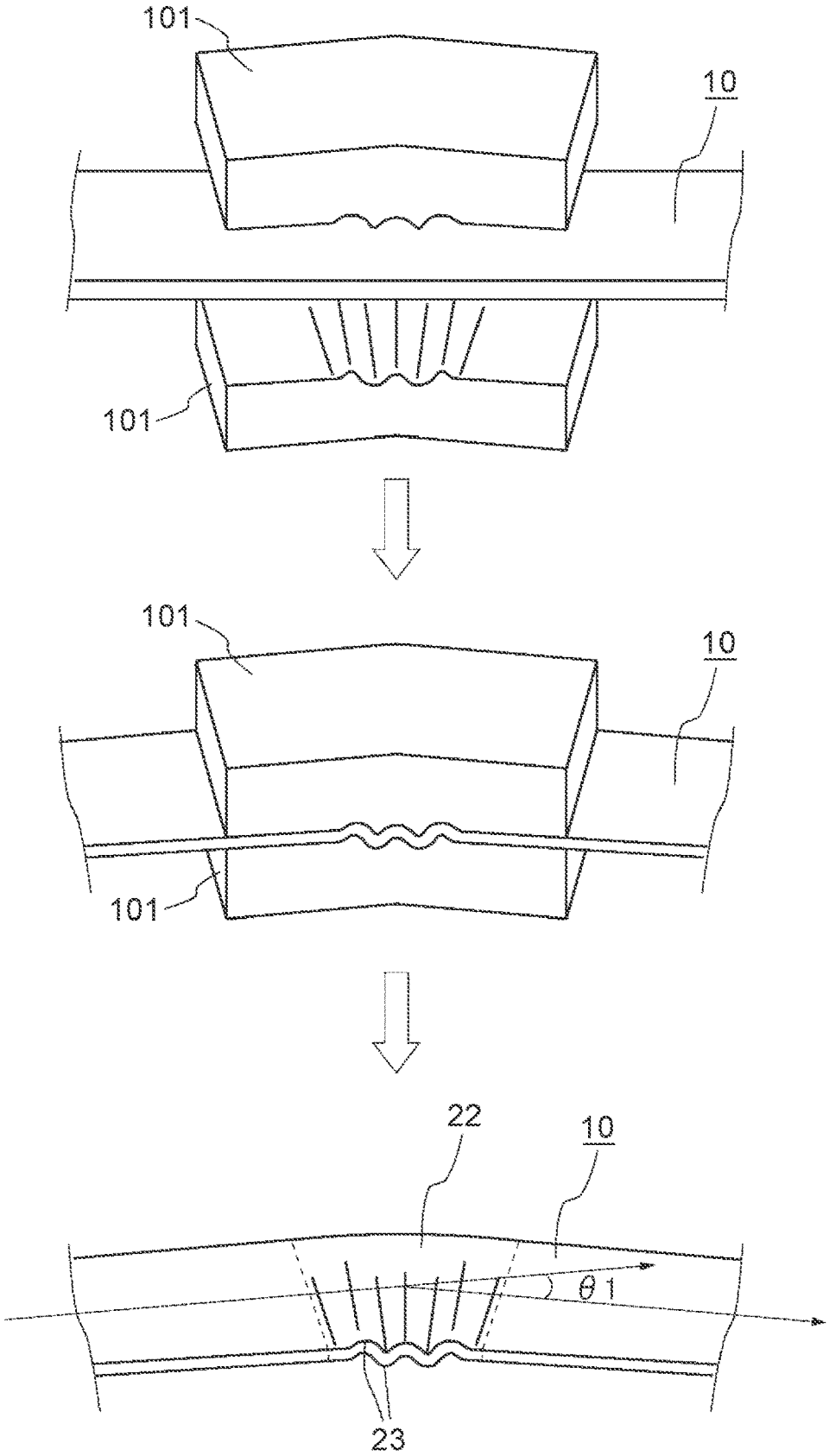
FIG. 2 is a view illustrating a manufacturing method of a routing material according to one embodiment.
Figure 3:
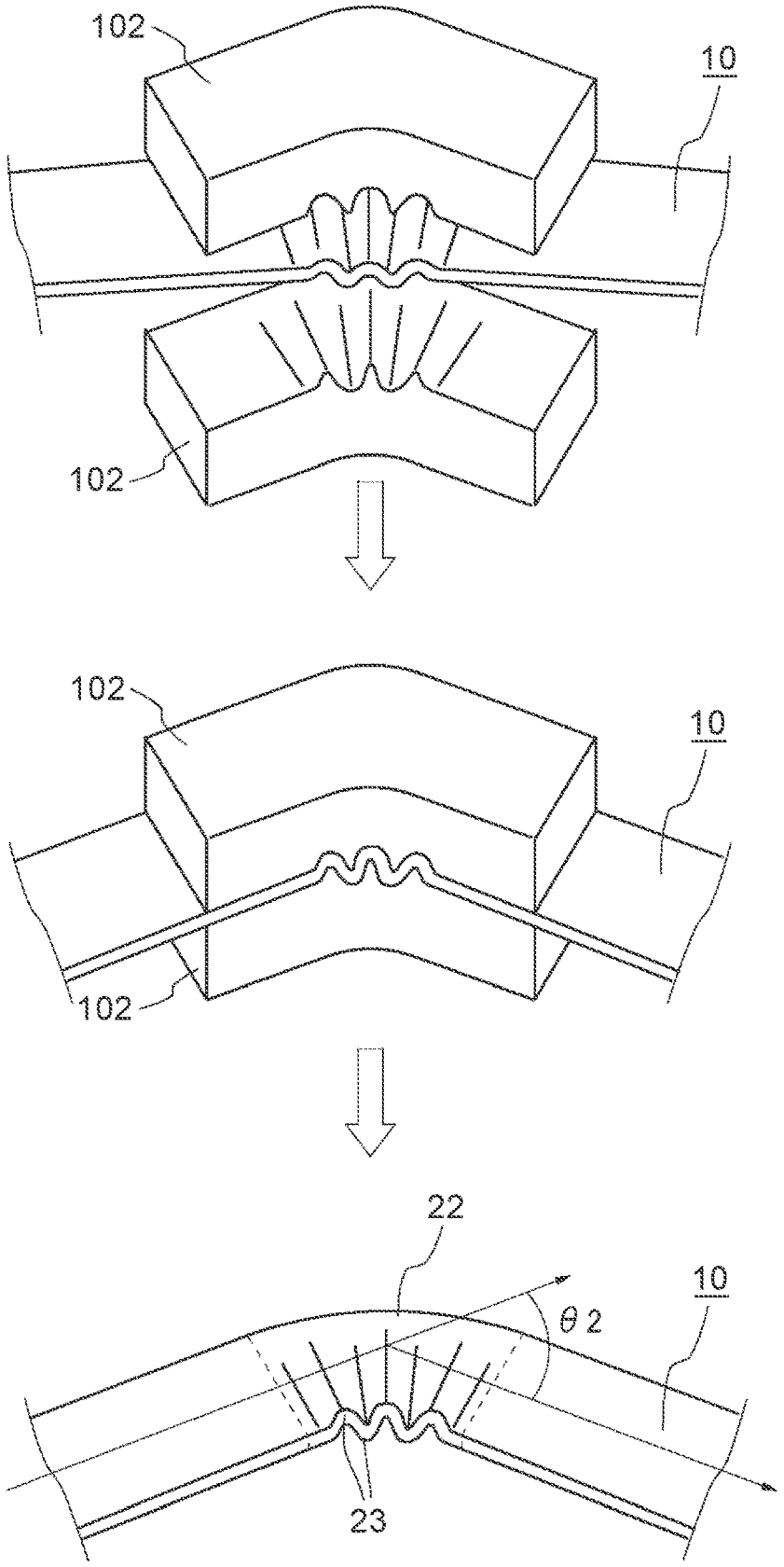
FIG. 3 is a view illustrating the manufacturing method of the routing material according to one embodiment.
Figure 4:
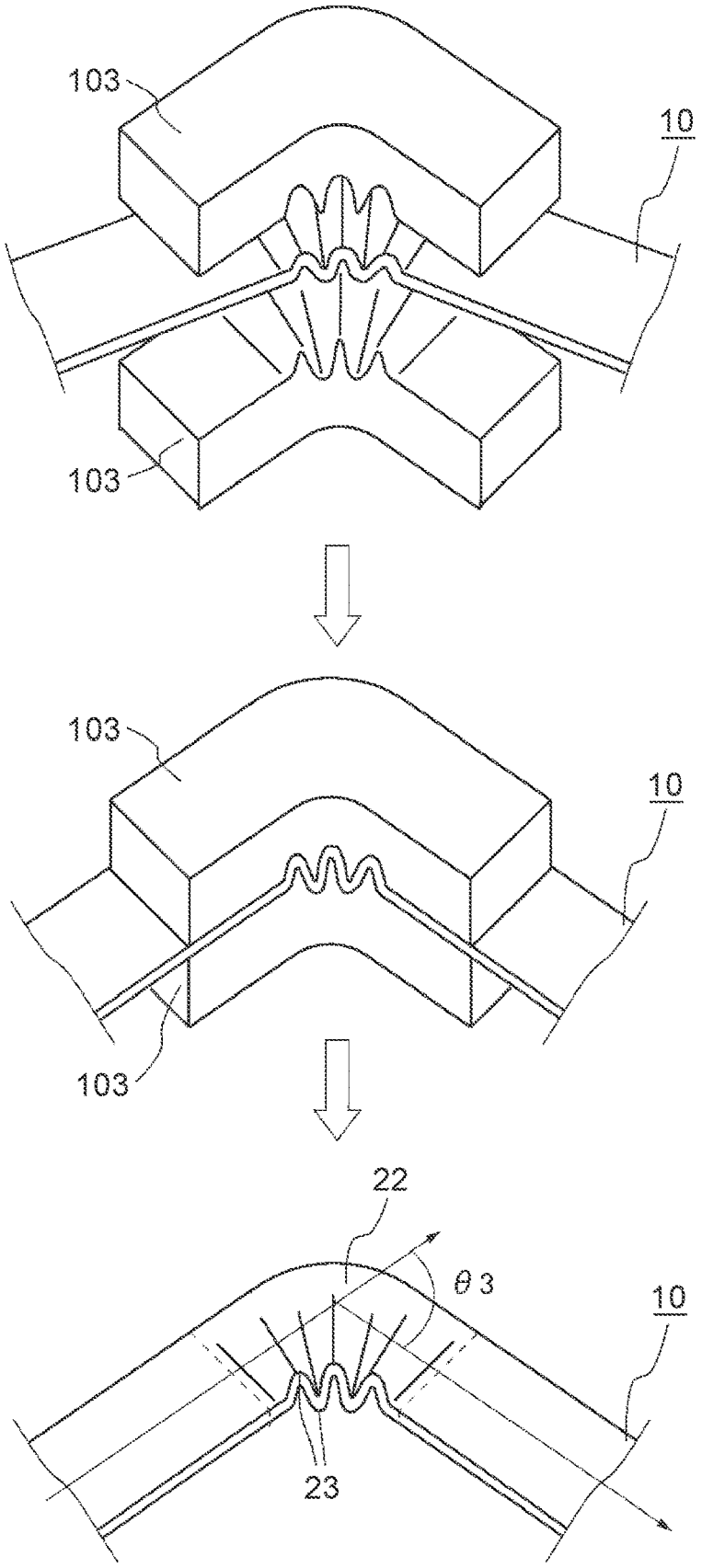
FIG. 4 is a view illustrating the manufacturing method of the routing material according to one embodiment.

With reference to FIGS. 2, 3, 4, the following describes a method for forming the bent portion 22 of the routing material 10. First, as illustrated in FIG. 2, a machining portion at a predetermined position where the bent portion 22 is to be formed in the linear portion 21 of the routing material 10 is pressed by a first mold 101. A wave shape is formed on press surfaces of the first mold 101. When pressing is performed, folds 23 are formed on the machining portion, and the first side edge is gathered in a folded manner by the folds 23, so that the bent portion 22 the bending angle of which is a first angle θ1 is formed.

Subsequently, as illustrated in FIG. 3, the bent portion 22 of the routing material 10 is pressed by a second mold 102. A wave shape having a larger difference in height than that of the press surfaces of the first mold 101 is formed on press surfaces of the second mold 102. When pressing is performed, the height of the folds 23 further increases, and the first side edge is further gathered in a folded manner by the folds 23, so that the bending angle of the bent portion 22 becomes a second angle θ2 (>θ1) larger than the first angle θ1.

Subsequently, as illustrated in FIG. 4, the bent portion 22 of the routing material 10 is pressed by a third mold 103. A wave shape having a larger difference in height than that of the press surfaces of the second mold 102 is formed on press surfaces of the third mold 103. When pressing is performed, the height of the folds 23 further increases, and the first side edge is further gathered in a folded manner by the folds 23, so that the bending angle of the bent portion 22 becomes a third angle θ3 (>θ2) larger than the second angle θ2.

As such, by performing edgewise bending such that the folds 23 are formed by press working so as to gather the inner peripheral side in a folded manner, it is possible to restrain distortion caused in the conductive material 11 from exceeding a forming limit at which cracks, splits, breaks, and the like occur.

Particularly, the folds 23 are gradually increased and the bending angle is gradually increased by performing press working several times, it is possible to further easily perform machining without exceeding the forming limit until a target bending angle is achieved.

As an example, in a case where the conductive material 11 is a flat conductive material made of A1000-based aluminum material with a thickness of 1 mm and a width of 20 mm, a bending angle of 90° can be achieved by performing press working three times.

In this case, the number of folds 23 is set to 10, and by the first press working, the maximum deformation amount in height toward the upper side and the lower side in a part where the folds 23 are formed can be 1.5 mm, and the bending angle θ1 can be 30°.

Further, by the second press working, the maximum deformation amounts toward the upper side and the lower side in the part where the folds 23 are formed can be 3.0 mm, and the bending angle θ2 can be 60°.

Further, by the third press working, the maximum deformation amounts toward the upper side and the lower side in the part where the folds 23 are formed can be 4.0 mm, and the bending angle θ3 can be 90°.

Note that, on the assumption of recovery after machining, a final bending angle by the last press working may be set to be larger than a target bending angle.

The number and size of the folds 23 and the number of times of press working are not limited and can be set appropriately in accordance with the forming limit characteristic, thickness, width, target bending angle, and so on of the material of the conductive material 11. Further, the number of times of press working may be one. Further, the material of the conductive material 11 is not limited to aluminum, and various types of metal and alloy such as copper or iron can be selected.

Effects

Thus, in one embodiment of this disclosure, bending is performed such that the folds 23 are provided on the inner peripheral side to be gathered in a folded manner. Accordingly, edgewise bending can be performed on a routing material provided with an insulating coating at a normal temperature of 10° C. to 40° C., for example, without heating. This makes it possible to restrain deterioration and tearing of the insulating coating even without using a heat-resistant insulating coating. Further, this makes it possible to achieve a wide selection of material for the insulating coating.

Further, it is possible to easily adjust the shapes of the molds and a load at the time of pressing so as to restrain changes in the thickness of the conductive material 11 in press working, and the thickness of the conductive material 11 can be maintained to be generally uniform before and after bending. Hereby, even when edgewise bending is performed, it is possible to restrain the thickness of the conductive material from becoming uneven, thereby making it possible to restrain a decrease in current application performance of the conductive material.

Further, in press working, a load is applied in the thickness direction of the conductive material 11. Accordingly, in comparison with a case where a load is applied in a stretching direction like general edgewise bending, the load can be decreased, so that machining on the conductive material 11 can be easily performed by a relatively small facility or by human power.

This disclosure is useful for a routing material to be used in vehicles or the like.

What is claimed is:

1. A flat routing material comprising:

a flat conductive material; and an insulating coating covering the conductive material, wherein:

the routing material includes a bent portion as a part bending to an edgewise direction at a predetermined angle or more; and one or more folds extending toward an outer peripheral side of the bent portion are provided only on an inner peripheral side of the bent portion.

2. The routing material according to claim 1, wherein the conductive material has a uniform thickness.

3. The routing material according to claim 1, wherein the conductive material is made of aluminum.

4. A manufacturing method of a routing material, the manufacturing method comprising:

a step of bending, to an edgewise direction, a flat routing material including a flat conductive material and an insulating coating covering the conductive material, by pressing the routing material by a mold so as to form one or more folds only on a first edge side of the routing material such that the one or more folds extend toward a second edge side of the routing material, wherein the routing material is bent such that the first edge side becomes an inner peripheral side of the routing material.

5. The manufacturing method according to claim 4, wherein, in the step of bending the routing material, the conductive material has a uniform thickness.

6. The manufacturing method according to claim 4, comprising a plurality of steps of bending the routing material, wherein each of the steps is performed by use of different molds such that a height of the folds is gradually increased, and a bending angle of the routing material is gradually increased.

* * * * *